US012325579B2

(12) United States Patent
Eickhoff et al.

(10) Patent No.: US 12,325,579 B2
(45) Date of Patent: Jun. 10, 2025

(54) BEVERAGE CAPSULE CUP WITH ENHANCED MATERIAL DISTRIBUTION

(71) Applicant: Berry Global, Inc., Evansville, IN (US)

(72) Inventors: Jonathan Eickhoff, Evansville, IN (US); Jared Bruce Waterman, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 17/508,552

(22) Filed: Oct. 22, 2021

(65) Prior Publication Data

US 2022/0127068 A1 Apr. 28, 2022

Related U.S. Application Data

(60) Provisional application No. 63/104,127, filed on Oct. 22, 2020.

(51) Int. Cl.
*B65D 85/80* (2006.01)
*B65D 85/804* (2006.01)

(52) U.S. Cl.
CPC ..... *B65D 85/8043* (2013.01)

(58) Field of Classification Search
CPC ..... B65D 85/8043; B65D 85/804; B65D 85/8046
See application file for complete search history.

(56) References Cited

U.S. PATENT DOCUMENTS

| | | | |
|---|---|---|---|
| 3,077,284 | A | 2/1963 | McLaughlin |
| 3,530,917 | A | 9/1970 | Donovan |
| 3,721,367 | A | 3/1973 | Fletcher |
| 3,795,182 | A | 3/1974 | Van Damme |
| 4,847,148 | A | 7/1989 | Schirmer |
| 4,935,089 | A | 6/1990 | Schirmer |
| 5,012,928 | A | 5/1991 | Proffitt |
| 5,325,765 | A | 7/1994 | Sylvan |
| 5,840,189 | A | 11/1998 | Sylvan et al. |
| 5,849,401 | A | 12/1998 | El-Afandi et al. |
| 5,856,406 | A | 1/1999 | Silvis |
| 5,927,179 | A | 7/1999 | Mordini |
| D438,794 | S | 3/2001 | Miles |
| D452,433 | S | 12/2001 | Lazaris |
| D452,434 | S | 12/2001 | Sweeney, Jr. |
| 6,440,256 | B1 | 8/2002 | Gordon |
| D468,202 | S | 1/2003 | Chou |
| D474,110 | S | 5/2003 | Sweeney, Jr. |
| D474,111 | S | 5/2003 | Lazaris |
| 6,589,577 | B2 | 7/2003 | Lazaris |
| 6,607,762 | B2 | 8/2003 | Lazaris |

(Continued)

FOREIGN PATENT DOCUMENTS

| | | |
|---|---|---|
| CA | 2586792 C | 2/2010 |
| CA | 2618863 C | 3/2011 |

(Continued)

OTHER PUBLICATIONS

International Search Report and Written Opinion for PCT/EP2019/065625, dated Jan. 9, 2020.

(Continued)

*Primary Examiner* — Ericson M Lachica
(74) *Attorney, Agent, or Firm* — Barnes & Thornburg LLP

(57) ABSTRACT

A beverage brewing cup with a floor having a puncture area is disclosed.

19 Claims, 7 Drawing Sheets

(56) References Cited

U.S. PATENT DOCUMENTS 6,645,537 B2 11/2003 Sweeney
6,655,260 B2 12/2003 Lazaris
6,810,788 B2 11/2004 Hale
D502,362 S 3/2005 Lazaris
6,884,450 B2 4/2005 Wu
D511,965 S 11/2005 Luc
D513,152 S 12/2005 Cahen
D515,970 S 2/2006 Hensen
D519,831 S 5/2006 de Cleir
7,105,106 B2 9/2006 Samuels et al.
D546,672 S 7/2007 Chou
D551,909 S 10/2007 Eide
7,328,651 B2 2/2008 Halliday
D568,156 S 5/2008 Wilson
D570,650 S 6/2008 Vovan
D574,703 S 8/2008 Cassol
D577,288 S 9/2008 Wilson
D577,994 S 10/2008 Kessell
7,464,638 B2 12/2008 Tremblay
7,476,710 B2 1/2009 Mehta
7,531,198 B2 5/2009 Cortese
7,585,917 B2 9/2009 Datta
D606,363 S 12/2009 Aardenburg
D607,315 S 1/2010 George
D607,329 S 1/2010 Diss
7,662,885 B2 2/2010 Coffey
7,685,931 B2 3/2010 Rivera
D637,484 S 5/2011 Winkler
D638,290 S 5/2011 Cimmerer
D647,398 S 10/2011 Winkler
D647,399 S 10/2011 Winkler
D649,037 S 11/2011 Cimmerer
D649,054 S 11/2011 Sharma
8,053,051 B2 11/2011 Kitahara et al.
8,067,501 B2 11/2011 Fiscus et al.
D652,292 S 1/2012 Riales
8,173,747 B2 5/2012 Grein
D663,999 S 7/2012 Scrivani
8,252,351 B2 8/2012 Ozanne
D668,538 S 10/2012 Knutson
8,291,812 B2 10/2012 Rivera
8,361,527 B2 1/2013 Winkler
D675,519 S 2/2013 Knuston
8,409,676 B2 4/2013 Furneaux
D681,448 S 5/2013 O'Malley
D686,916 S 7/2013 OBrien
8,474,368 B2 7/2013 Kilber et al.
D687,297 S 8/2013 OBrien et al.
8,522,669 B1 9/2013 Rolfes
D697,797 S 1/2014 Hansen
8,621,981 B2 1/2014 Rivera
D698,649 S 2/2014 Quint
D700,839 S 3/2014 OBrien et al.
8,685,479 B2 4/2014 Dogan
8,720,320 B1 5/2014 Rivera
D708,057 S 7/2014 Hansen
D710,686 S 8/2014 Gowens
8,794,125 B1 8/2014 Rivera
8,808,778 B2 8/2014 Dakis
8,828,895 B2 9/2014 Foss et al.
D715,649 S 10/2014 OBrien
D716,648 S 11/2014 Tan
D730,174 S 5/2015 OBrien
9,085,410 B2 7/2015 Beer
D736,615 S 8/2015 OBrien et al.
D747,187 S 1/2016 Cochran
9,260,596 B2 2/2016 Kashiba et al.
9,326,635 B2 5/2016 Koestring et al.
9,415,913 B1 8/2016 Lanctuit et al.
9,732,167 B2 8/2017 Okada et al.
11,000,148 B2 5/2021 Conant et al.
2002/0020659 A1 2/2002 Sweeney
2003/0222089 A1 12/2003 Hale
2004/0045443 A1 3/2004 Lazaris
2005/0051478 A1 3/2005 Karanikos
2005/0287251 A1 12/2005 Lazaris
2007/0098933 A1 5/2007 Opuszko
2007/0144356 A1 6/2007 Rivera
2010/0064899 A1 3/2010 Aardenburg
2010/0288131 A1 11/2010 Kilber
2010/0303964 A1 12/2010 Beaulieu
2011/0041702 A1 2/2011 Yoakim
2011/0064852 A1 3/2011 Mann
2011/0151075 A1 6/2011 Peterson
2011/0274802 A1 11/2011 Rivera
2012/0097602 A1 4/2012 Tedford
2012/0118166 A1* 5/2012 Macchi ..... B65D 85/8061 99/295
2012/0207895 A1 8/2012 Rivera
2012/0207896 A1 8/2012 Rivera
2012/0241352 A1 9/2012 Pramanik
2012/0276264 A1 11/2012 Rivera
2012/0308688 A1 12/2012 Peterson
2013/0059039 A1 3/2013 Trombetta
2013/0061764 A1 3/2013 Rivera
2013/0064936 A1 3/2013 Meelker
2013/0068108 A1 3/2013 Rivera
2013/0101716 A1 4/2013 Beaulieu
2013/0122167 A1 5/2013 Winkler
2013/0129872 A1 5/2013 Kruger
2013/0323129 A1 12/2013 Carmichael et al.
2013/0323370 A1 12/2013 Gerbaulet
2013/0340626 A1 12/2013 Oh
2013/0344205 A1 12/2013 Oh
2014/0106036 A1 4/2014 Cardoso
2014/0120217 A1 5/2014 O'Brien et al.
2014/0120218 A1 5/2014 O'Brien et al.
2014/0120288 A1 5/2014 Leser
2014/0141128 A1 5/2014 Trombetta
2014/0161937 A1 6/2014 Rondelli
2014/0178538 A1 6/2014 Husband
2014/0196608 A1 7/2014 Amrein
2014/0212546 A1 7/2014 Koestring et al.
2014/0220191 A1 8/2014 Kelly et al.
2014/0272018 A1 9/2014 Koller et al.
2014/0290493 A1 10/2014 Rivera
2014/0308405 A1 10/2014 Okada et al.
2014/0308406 A1 10/2014 O'Brien et al.
2014/0311098 A1 10/2014 Hooft et al.
2014/0318380 A1 10/2014 Doglioni Majer
2014/0363655 A1 12/2014 Yoshida
2015/0191607 A1 7/2015 McDaniel
2015/0298897 A1* 10/2015 Kay ..... B65D 85/8043 426/115
2015/0314954 A1* 11/2015 Empl ..... A23F 3/18 426/115
2015/0336736 A1* 11/2015 Cabilli ..... B65D 65/466 264/494
2016/0016389 A1 1/2016 Dias
2016/0039601 A1 2/2016 Doglioni Majer
2016/0227957 A1 8/2016 Koestring et al.
2016/0332805 A1 11/2016 Krupa
2016/0355306 A1 12/2016 Robin
2017/0036854 A1 2/2017 Doglioni Majer
2017/0042362 A1* 2/2017 Bunner ..... B65D 21/0233
2017/0055761 A1 3/2017 Roberts
2017/0121050 A1 5/2017 Foster
2017/0266933 A1 9/2017 Lee et al.
2017/0367521 A1 12/2017 Conant et al.
2018/0001604 A1 1/2018 Van Loon et al.
2018/0042258 A1 2/2018 Roberts
2018/0079564 A1 3/2018 Darby
2018/0118450 A1 5/2018 Trombetta
2018/0228314 A1* 8/2018 Putnam ..... B65D 1/28
2018/0334319 A1* 11/2018 Cabilli ..... B65D 85/8061
2019/0084759 A1* 3/2019 Tung ..... B65D 85/8043
2019/0119036 A1* 4/2019 Nordqvist ..... B65D 85/8043
2019/0329969 A1* 10/2019 Borse ..... B65D 85/8043
2021/0070537 A1 3/2021 Bunner et al.
2021/0228017 A1 7/2021 Conant

(56) References Cited

U.S. PATENT DOCUMENTS

FOREIGN PATENT DOCUMENTS

| | | | |
|---|---|---|---|
| CA | 2840141 | A1 | 12/2012 |
| CA | 2650797 | C | 5/2014 |
| CA | 2932176 | A1 | 6/2015 |
| ES | 1073281 | | 11/2010 |
| WO | 2012076135 | A1 | 6/2012 |
| WO | 2013132436 | A1 | 9/2013 |
| WO | 2014128315 | | 8/2014 |
| WO | 2015191565 | A1 | 12/2015 |
| WO | 2016174671 | | 11/2016 |
| WO | 2019238898 | A2 | 12/2019 |

OTHER PUBLICATIONS

Braskem Regulatory Information Sheet for Inspire 6025N Polypropylene Resin, 12 pages.
Braskem information sheet for Inspire 6025N Polypropylene, 1 page.
Office Action dated Jun. 29, 2018 for U.S. Appl. No. 15/236,010 (p. 1-13).
Office Action dated Feb. 19, 2019 for U.S. Appl. No. 15/236,010 (pp. 1-15).
Office Action dated Aug. 6, 2019 for U.S. Appl. No. 15/631,236 (pp. 1-9).
Office Action dated Oct. 18, 2019 for U.S. Appl. No. 15/236,010, (pp. 1-16).
Office Action dated Feb. 4, 2020, for U.S. Appl. No. 15/631,236, (pp. 1-10).
Office Action dated May 15, 2020 for U.S. Appl. No. 15/236,010, (pp. 1-21).
Mexican Office Action for Mexican Patent App. No. MX/a/2017/08605 dated Feb. 5, 2021, 5 pages.
Office Action (Non-Final Rejection) dated Jan. 24, 2022 for U.S. Appl. No. 17/099,081 (pp. 1-20).
Office Action (Final Rejection) dated Sep. 8, 2022 for U.S. Appl. No. 17/099,081, (pp. 1-31).
Office Action (Non-Final Rejection) dated Nov. 21, 2022 for U.S. Appl. No. 17/229,266, (pp. 1-11).
Office Action (Non-Final Rejection) dated Apr. 27, 2023 for U.S. Appl. No. 17/251,569, (pp. 1-24).
Office Action (Final Rejection) dated May 2, 2023 for U.S. Appl. No. 17/229,266, (pp. 1-10).
Office Action (Final Rejection) dated Sep. 6, 2023 for U.S. Appl. No. 17/251,569 (pp. 1-21).
Canadian Office Action for Canadian App. No. 2971930 dated 14 Sep. 2023, 4 pages.
Office Action (Non-Final Rejection) dated Oct. 17, 2023 for U.S. Appl. No. 17/099,081, (pp. 1-34).
Office Action (Non-Final Rejection) dated Apr. 25, 2024 for U.S. Appl. No. 17/251,569 (pp. 1-30).
Office Action (Final Rejection) dated May 10, 2024 for U.S. Appl. No. 17/099,081 (pp. 1-36).
Office Action (Final Rejection) dated Sep. 24, 2024 for U.S. Appl. No. 17/251,569, (pp. 1-9).
Office Action (Non-Final Rejection) dated Sep. 27, 2024 for U.S. Appl. No. 17/229,266, (pp. 1-9).

* cited by examiner

BEVERAGE CAPSULE CUP WITH ENHANCED MATERIAL DISTRIBUTION

PRIORITY CLAIM

This application claims priority under 35 U.S.C. § 119(e) to U.S. Provisional Application Ser. No. 63/104,127 filed Oct. 22, 2020, which is expressly incorporated by reference herein.

TECHNICAL FIELD

The present disclosure relates generally to beverage capsule cup, and more specifically to a beverage capsule cup with enhanced material distribution, for example, in the bottom wall or floor of the cup, which may allow for a cup floor that is more easily punctured by a beverage brewing apparatus.

BACKGROUND

It is often desirable to make a beverage capsule for holding beverage brewing contents, such as coffee grounds and/or beverage flavoring, and the capsule may include a cup that may hold the contents and/or be punctured. For example, the cup may include a bottom wall or floor that may be punctured by a needle of a beverage brewing apparatus so that the contents may be used to brew or provide a beverage.

SUMMARY

Certain embodiments according to the present disclosure provide a beverage capsule cup with enhanced material distribution.

In one aspect, for instance, some embodiments may provide a beverage brewing cup, having a side wall and a floor at least partially defining a product storage region. The floor has a center area, an inner gusset area, a puncture area, and an outer gusset area. The center area is disposed axially above the puncture area, and the inner gusset area extends between the center area and the puncture area. The side wall is disposed axially above the puncture area and the outer gusset area extends between the puncture area and the side wall. The inner gusset area includes a plurality of inner gussets. The outer gusset area includes a plurality of outer gussets. The puncture area in the floor is disposed between the inner gusset area and the outer gusset area.

In another aspect, for instance, some embodiments may provide a beverage brewing cup having a side wall and a floor at least partially defining a product storage region. A brim is disposed axially opposite the floor, the brim surrounding an opening into the product storage region. The floor has a center area, an inner gusset area, a puncture area, and an outer gusset area. The center area is disposed axially above the puncture area and the inner gusset area extending between the center area and the puncture area. The side wall is disposed axially above the puncture area and the outer gusset area extending between the puncture area and the side wall. The puncture area in the floor disposed between the inner gusset area and the outer gusset area. The puncture area having a thickness that is less than a thickness of the center area.

In yet another aspect, for instance, some embodiments may provide a beverage brewing cup having a side wall and a floor at least partially defining a product storage region. The floor has a center area, an inner gusset area, a puncture area, and an outer gusset area. The center area is disposed axially above the puncture area and the inner gusset area extending between the center area and the puncture area. The side wall is disposed axially above the puncture area and the outer gusset area extend between the puncture area and the side wall. The inner gusset area includes a plurality of inner gussets. The outer gusset area includes a plurality of outer gussets. The puncture area in the floor is disposed between the inner gusset area and the outer gusset area. The beverage brewing cup is thermoformed such that the puncture area is thinner than the center area.

BRIEF DESCRIPTION OF THE DRAWINGS

The detailed description particularly refers to the accompanying figures, in which.

DETAILED DESCRIPTION

Embodiments now will be described more fully hereinafter with reference to the accompanying drawings, in which some, but not all embodiments are shown. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
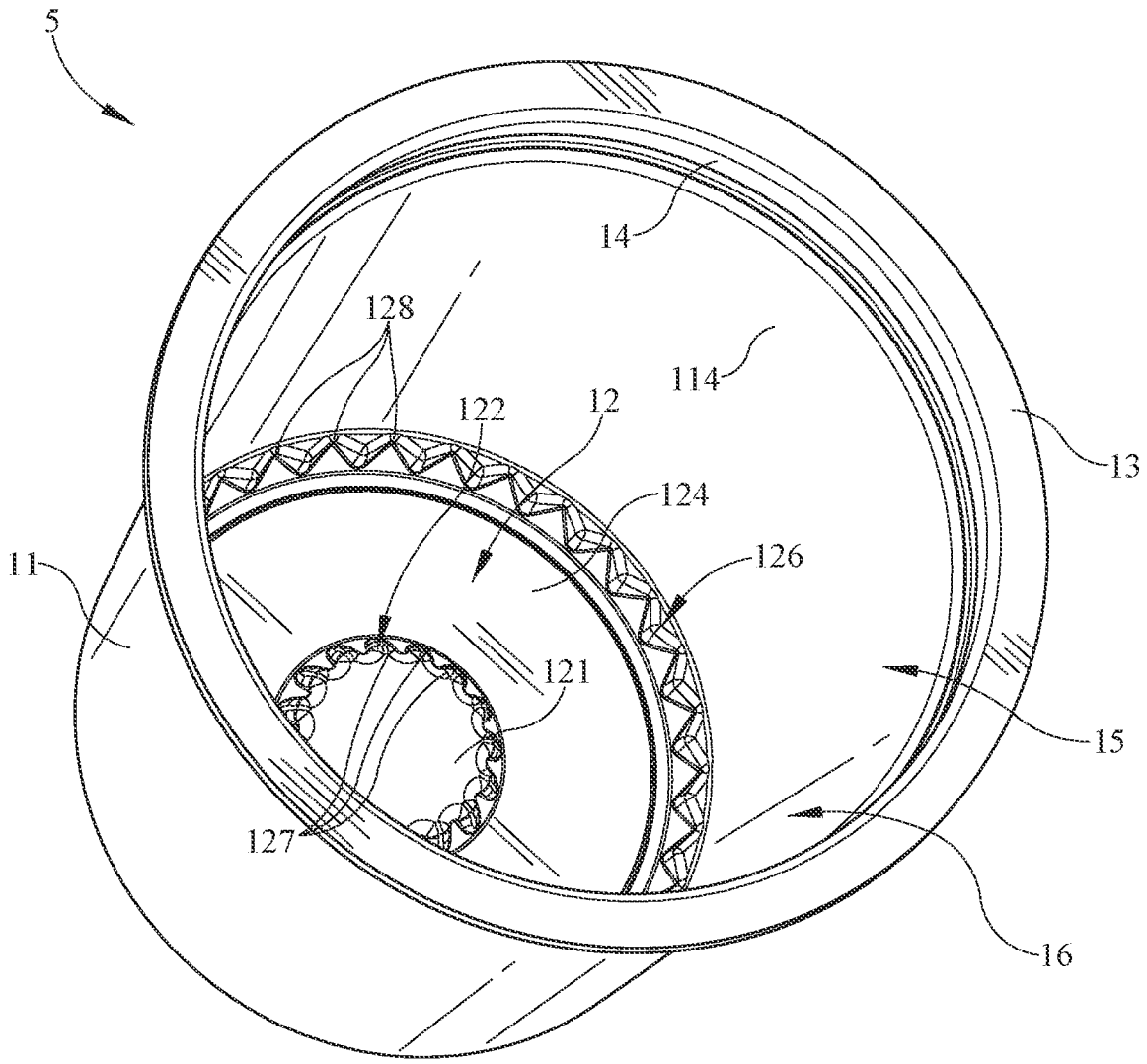
FIG. 1 illustrates a perspective view of an exemplary embodiment of beverage capsule cup.

Some embodiments of a beverage capsule cup or container 5 and components thereof are shown, for example, in FIG. 1. Cup 5 may include a product storage region 16 at least partially defined by a side wall 11 and/or a bottom or floor 12. Cup 5 may include a flange or brim 13 adjacent an opening 15 into product storage region 16 and/or adjacent an upper area 114 of side wall 11. Cup 5 may include features such as brim 13 and/or a shoulder 14 for any of a variety of reasons, including, but not limited to, to provide structural support and/or strengthen cup 5, to provide a lidding surface to contain and/or seal contents in product storage region 16, and/or to facilitate stacking of one or more cups 5, for example. Other features such as structural features or surface features like flutes, ribs, bumps, recesses, etc. may be included, for example in side wall 11. It is understood that such features, if included, may be included in virtually any number or variety, they may be arranged in virtually any manner, for example symmetrical or asymmetrical, any or all of them may extend for virtually any amount of the height, width, and/or thickness of cup 5 or side wall 11 anywhere from floor 12 to brim 13 or anywhere in between.

Cup 5 may include a lid (not shown) for any of a variety of reasons, including but not limited to providing a sealed package for storing contents and/or for extending the life or shelf life of the contents. For example, container 5 may include contents for preparing a beverage, such as coffee grounds, tea leaves, or the like. In this example or in other embodiments, a lid may be puncturable or piercable for use in a beverage brewing apparatus, for instance. To help provide an extended shelf life, or for any other reason, cup 5 or any portion thereof may include a barrier or barrier properties, for example, to prevent, inhibit, and/or slow the transmission of oxygen or other gases that may through and/or into cup 5.

Side wall 11 may have an upper area 114 and/or a lower area 113. Upper area 114 may be proximate shoulder 14 and lower area 113 may be proximate floor 12. Side wall 11 and/or upper area 114 or lower area 113 may have a side wall thickness measured from an outside surface to an inside surface of side wall 11. Side wall 11, together with bottom 12, may at least partially define product storage region 16.

Figure 2:
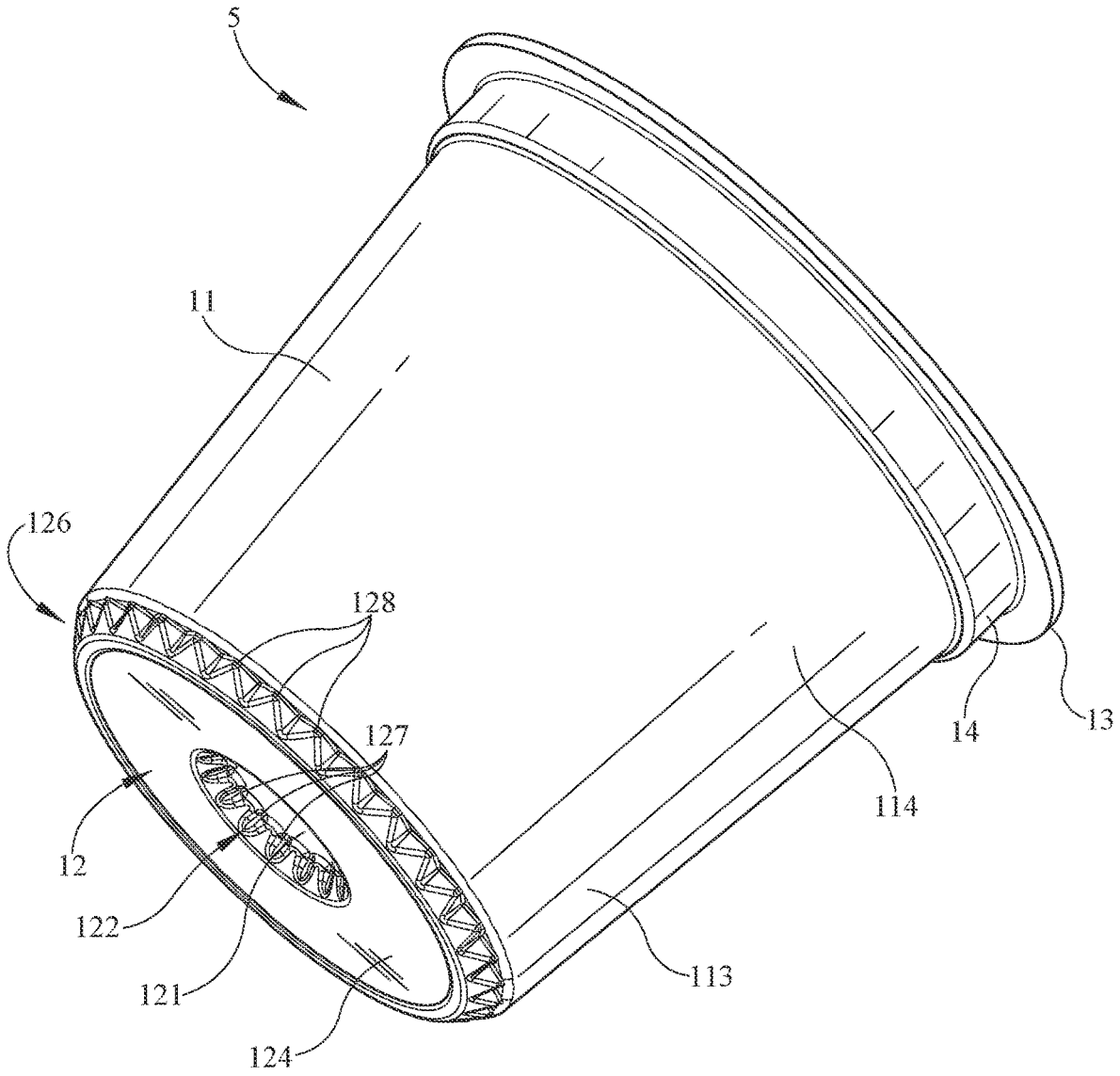
FIG. 2 illustrates another perspective view of the beverage capsule cup of FIG. 1.
Figure 3:
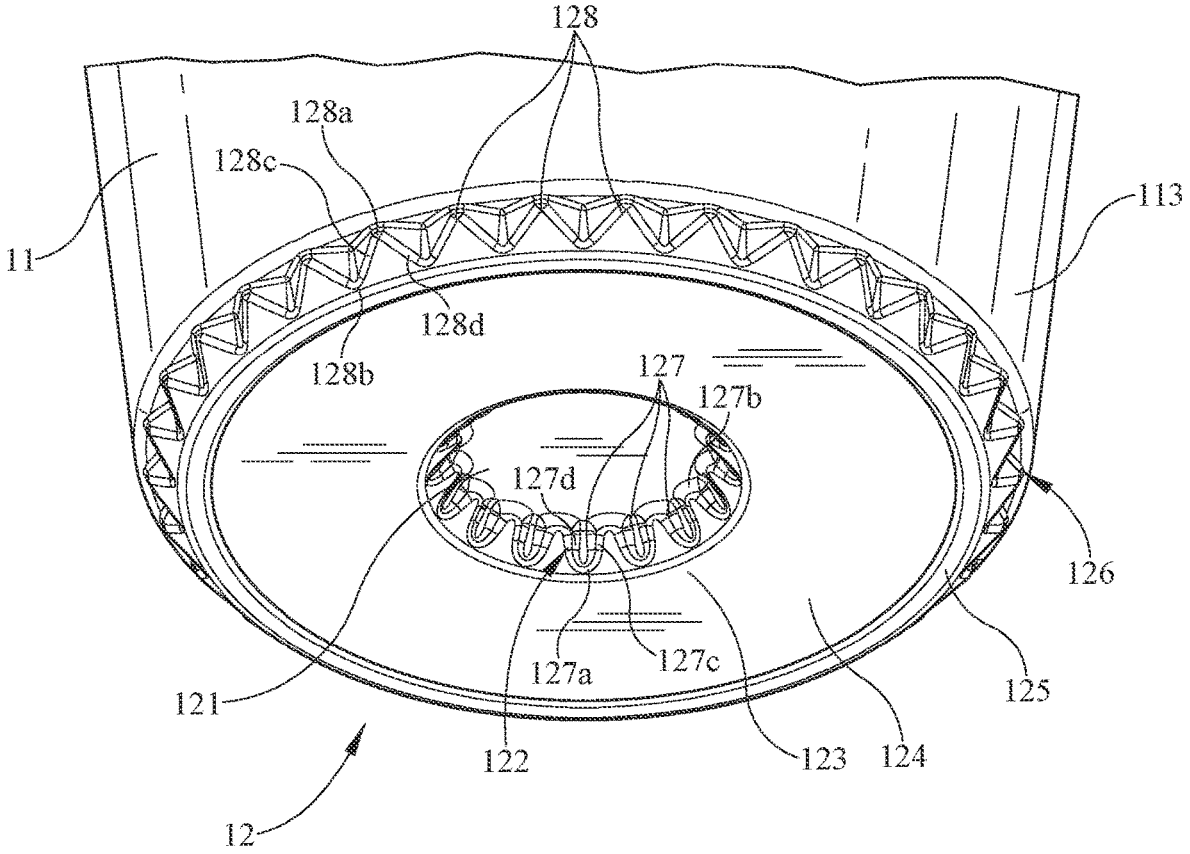
FIG. 3 illustrates a bottom perspective view of a portion of the beverage capsule cup of FIG. 2 showing the floor in more detail.

Floor 12 may have a center area 121 and/or a puncture area 124, as shown for example, in FIGS. 2 and 3. Puncture area 124 may be configured to be pierced or punctured, for example, by an outlet needle or the like of a beverage brewing apparatus. Puncture area 124 may have an inner edge 123 and/or an outer edge 125, either or both of which may at least partially define a boundary of puncture area 124. Puncture area 124 may be stepped up or down relative to center area 121 and/or side wall 11 and/or lower area 113 of side wall 11. For example, when set upright with floor 12 downward and brim 13 upward, puncture area 124 may be stepped down relative to center area 121 by an inner gusset area 122, and/or puncture area 124 may be stepped down relative to lower area 113 of side wall 11 by an outer gusset area 126. Inner edge 123 and/or outer edge 125 may be curved and/or stepped relative to puncture area 124, for example with a relatively slight step down relative to puncture area 124 as shown in FIG. 3. A step or curve or the like at inner edge 123 and/or outer edge 125 may provide additional structural rigidity to floor 12.

Inner gusset area 122 and/or outer gusset area 126 may include structural elements such as inner gussets 127 and/or outer gussets 128, for example, to provide additional structural rigidity. Any or all gussets 128 in outer gusset area 126 may be substantially triangular in shape as shown in FIG. 3, or any other shape. Any or all gussets 127 in inner gusset area 122 may be triangular in shape and/or have somewhat blended, curved, or smoothed edges or corners as shown for example in FIG. 3. It is understood the shapes shown are examples and any of a variety of shapes, sizes, and/or configurations of gussets 127, 128 or other structures may be used instead of or in addition to the gussets 127, 128 shown in the figures. For example, as shown in FIG. 3, cup 5 may include about 32 outer gussets 128 and/or about 16 inner gussets 127. It is understood that more or less than the number of inner gussets 127 and outer gussets 128 may be used, and the figures show one example. For example, inner gusset area 122 may include between about 8 and about 32 inner gussets 127 and/or outer gusset area 126 may include between about 12 and about 100 outer gussets 128.

Moreover, while the figures show each outer gusset 128 as substantially similar in shape, and each inner gusset 127 as substantially similar in shape, it is understood that the sizes, shapes, and/or configurations of inner gussets 127 and/or outer gussets 128 may vary from gusset to gusset. It is also understood that, while inner gusset area 122 is shown as including inner gussets 127 throughout its perimeter, and while outer gusset area 126 is shown as including outer gussets 128 throughout its perimeter, there could be areas of inner gusset area 122 and/or outer gusset area 126 that do not include gussets 127, 128. For example, in alternative embodiments, the perimeter of inner gusset area 122 may intermittently include inner gussets 127, with other portions of the perimeter substantially free of inner gussets 127. In in alternative embodiments, the perimeter of outer gusset area 126 may intermittently include outer gussets 128, with other portions of the perimeter substantially free of outer gussets 128.

In some embodiments, such as that shown in FIG. 3, any or all of inner gussets 127 may include a first tip 127*a*, a second tip 127*b*, a first side 127*c*, and/or a second side 127*d*. First tip 127*a* and/or second tip 127*b* may be rounded, blended, and/or curved for any of a variety of reasons, including but not limited to reducing stress concentrations and allowing easier part removal when cup 5 and/or floor 12 is formed. For example, if cup 5 is thermoformed, having rounded tips 127*a* and/or 127*b* with relatively large radii of curvature may facilitate part removal from the thermoformer. First tip 128*a* and/or second tip 128*b* of any or all outer gussets 128 may be rounded in similar fashion or otherwise and, as shown in FIG. 3., may have a smaller radii of curvature relative to inner tips 127*a* and/or 127*b*. Relatively larger radii of curvature of inner gusset tips 127*a* and/or 127*b* may give inner gussets 127 a shape that is triangular with rounded tips that are more pronounced than the rounded tips 128*a* and/or 128*b* of outer gussets 128. Relatively smaller radii of curvature may provide additional structural rigidity as compared to larger radii of curvature. Inner gussets 127 and outer gussets 128 are shown in more detail, for example, in FIGS. 7*a* and 7*b*.

First tips 127*a* of inner gusset 127 may be radially outward and/or lower than second tips 127*b* of inner gusset 127. First tips 128*a* of outer gusset 128 may be radially inward and/or lower than second tip 128*b* of outer gusset 128. As used here to discuss tips 127*a*, 127*b*, 128*a*, 128*b*, lower may mean nearer floor 12 or puncture area 124 in a direction measured from top (e.g., brim 13) to bottom (e.g., floor 12).

First side 127*c* and/or second side 127*d* of inner gusset 127 may extend from first tip 127*a* to an adjacent second tip 127*b*, or vice versa. First side 127*c* and/or second side 127*d* may extend in a radial direction and/or an axial direction transverse to the radial direction. First side 128*c* and/or second side 128*d* of outer gusset 128 may extend from first tip 128*a* to an adjacent second tip 127*b*, or vice versa. First side 128*c* and/or second side 128*d* may extend in a radial direction and/or an axial direction transverse to the radial direction. As used herein, directional terms such as "inner" or "outer" may be used to describe relative locations of features in the radial direction. Directional terms such as "higher", "lower", "upper", "above", "below", and the like may be used to describe relative locations of features in the axial or longitudinal direction.

Figure 4:
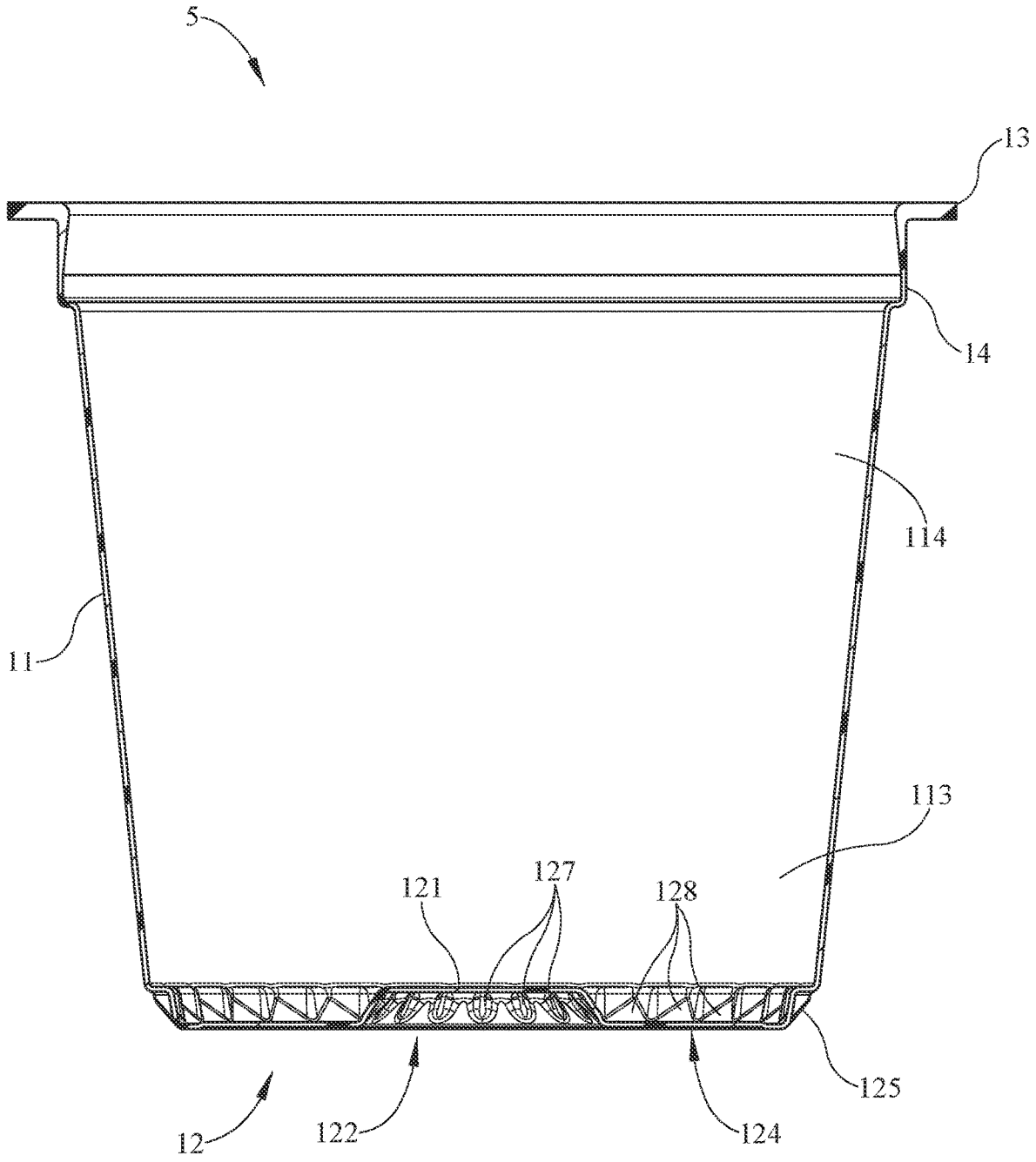
FIG. 4 illustrates a cross-section side view of the beverage capsule cup of FIG. 1.
Figure 5:
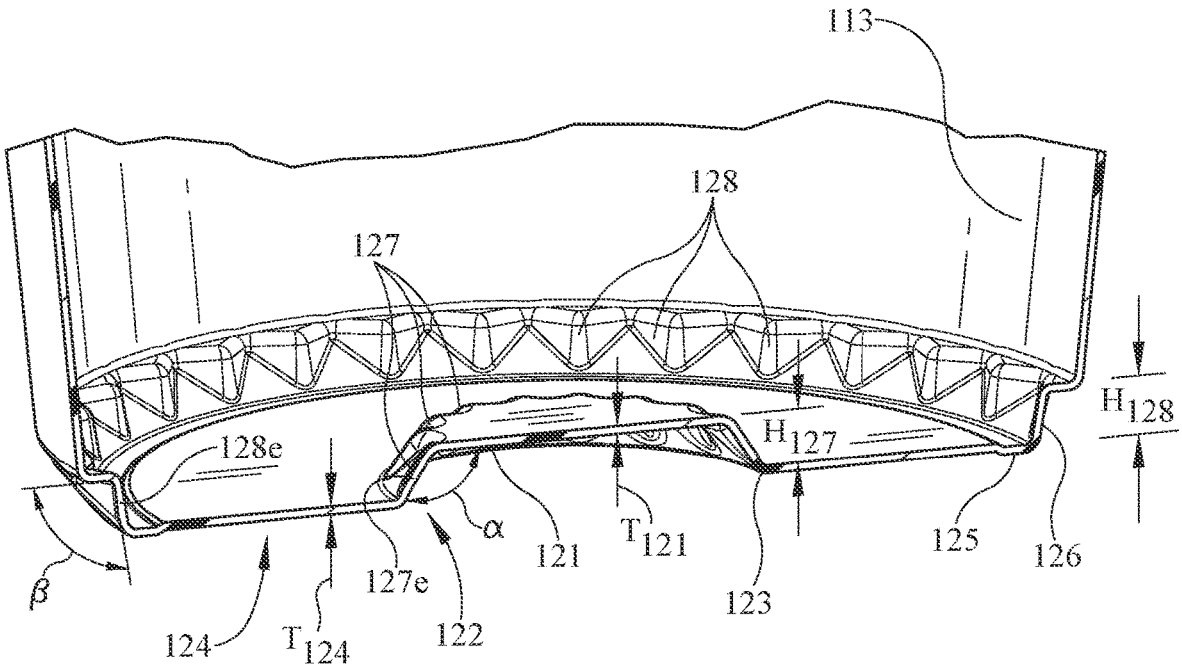
FIG. 5 illustrates a cross-section perspective view of a portion of the beverage capsule cup of FIG. 4 showing the floor in more detail.

As shown in FIGS. 4 and 5, center area 121 may be raised relative to puncture area 124. Center area 121 may have a thickness $T_{121}$ that is greater than a thickness $T_{124}$ of puncture area 124. For example, cup 5 may be thermoformed from a sheet of material having a substantially constant thickness, but through the thermoforming process the puncture area may be stretch and thinned more than center area to provide a lesser thickness $T_{124}$ than thickness $T_{121}$. Center area 121 may be raised relative to puncture area 124, which may correspond to the height $H_{127}$ of inner gusset area 122 or inner gussets 127, and/or inner gusset area 122 may be raised at an angle α relative to the horizontal, center area 121, and/or puncture area 124. For example, in some embodiments, height $H_{127}$ of inner gusset 127 may be about 0.073". It is understood that height $H_{127}$ could vary. For example, in some embodiments, $H_{127}$ may be between about 0.010" and about 0.300". Inner gusset 127 may have a front edge 127*e* extending at angle α relative to a substantially horizontal center area 121. In illustrative embodiments, front edge 127*e* may have a length of about 0.100" and angle α may be about 124 degrees. Front edge 127*e* may have a length in the range of about 0.010" to about 0.500" and/or angle α may be in the range of about 90 degrees to about 180 degrees, in the range of about 100 degrees to about 160 degrees, in the range of about 110 degrees to about 140 degrees, and/or in the range of about 120 degrees to about 130 degrees.

Outer gusset area 126 may include a step from floor 12 and/or outer edge 125 to a top of outer gusset 128 having a height Him. Outer gusset 128 may have a front edge 128*e* extending at an angle β relative to the horizontal. For example, in some embodiments, height $H_{128}$ of outer gusset 128 may be about 0.082". It is understood that height $H_{128}$ could vary. For example, in some embodiments, $H_{128}$ may be between about 0.010" and about 0.300". In illustrative embodiments, front edge 128*e* may have a length of about 0.085" and angle β may be about 100 degrees. Front edge 128*e* may have a length in the range of about 0.010" to about 0.500" and/or angle β may be in the range of about 90 degrees to about 180 degrees, in the range of about 95 degrees to about 160 degrees, in the range of about 95 degrees to about 120 degrees, and/or in the range of about 95 degrees to about 110 degrees.

Cup 5 or any portion thereof may have a thickness or variety of thicknesses. For example, material thickness and/or material distribution may be optimized for easy puncturability of floor 12 and/or puncture area 124 by a beverage brewing machine needle, for structural rigidity, and/or to provide a light weight cup 5 that includes less material than other pods or cups. In some embodiments, for example, cup 5 may be thermoformed of a thermoplastic material such as polypropylene or to include polypropylene. One or more parts of the mold may include a vented plug to allow optimized, enhanced, and/or thinned material distribution, for example, in floor 12 and/or puncture area 124.

Some exemplary cups 5 may be formed to include polyolefins such as polypropylene and/or to have material thickness of about or within the range of:

- at brim 13 of about 0.025" to about 0.045"
- at upper area 114 of about 0.009" to about 0.013"
- at lower area 113 of about 0.009" to about 0.020"
- at outer gusset area 126 of about 0.011" to about 0.018"
- at puncture area 124 of about 0.007" to about 0.016" ($T_{124}$)
- at center area 0.015" to about 0.030" and/or of about 0.015" to about 0.022" ($T_{121}$)

These or other embodiments of cup 5 may be formed, for example if thermoformed, from a sheet, disc, or piece of material that has a thickness in the range of about 0.020" to about 0.200", in the range of about 0.040" to about 0.100", in the range of about 0.050" to about 0.060", and/or about 0.058".

Figure 6:
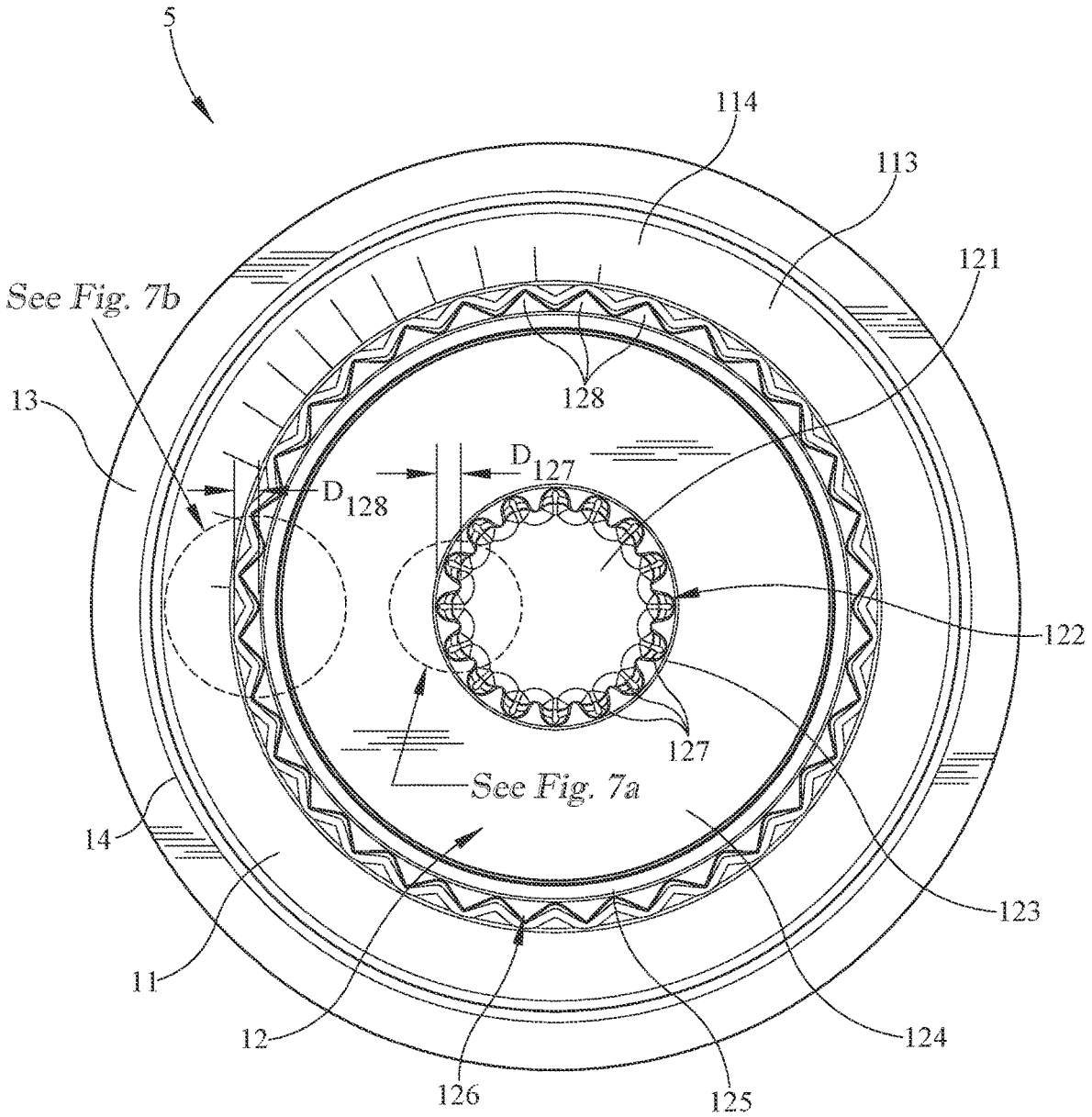
FIG. 6 illustrates a bottom view of the beverage capsule cup of FIG. 4.

As shown in FIG. 6, inner gusset area 122 and outer gusset area 126 may be substantially concentric circles of varying diameter, each including a series of inner gussets 127 and outer gussets 128, respectively. A portion of inner gusset area 122 is shown in more detail in FIG. 7*a* and a portion of outer gusset area 126 is shown in more detail in FIG. 7*b*. Any or all inner gussets 127 may have a depth $D_{127}$ measured in a radial direction from first tip 127*a* to second tip 127*b*. Any or all outer gussets 128 may have a depth $D_{128}$ measured in a radial direction from first tip 128*a* to second tip 128*b*. In some embodiments, outer gussets 128 may have a depth $D_{128}$ that is deeper or greater than a depth $D_{127}$ of inner gussets 127.

Figure 7A:
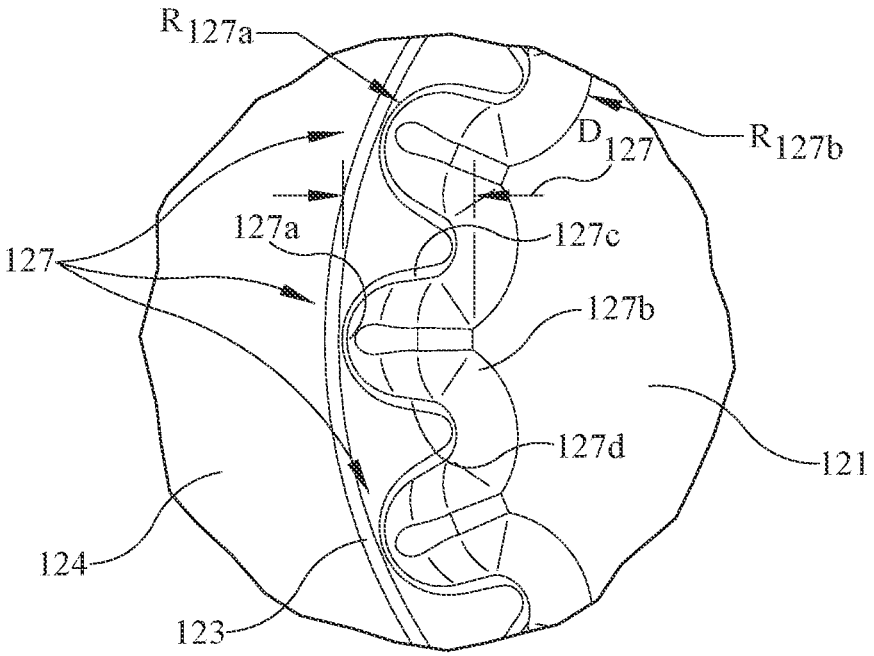
FIG. 7*a* illustrates a portion of a bottom of the beverage capsule of FIG. 6 to show inner gussets in more detail.
Figure 7B:
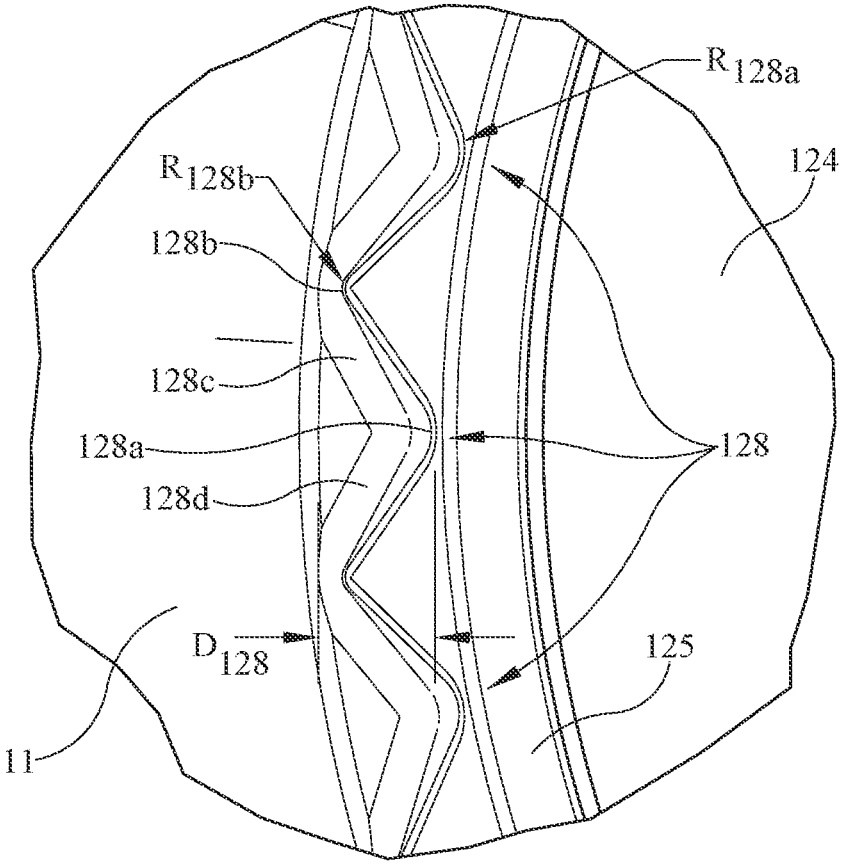
FIG. 7*b* illustrates another portion of the bottom of the beverage capsule of FIG. 6 to show outer gussets in more detail.

Inner gusset 127 may have a radius of curvature $R_{127a}$ at first tip 127*a* and/or a radius of curvature $R_{127b}$ at second tip 127*b*, as shown for example in FIGS. 7*a* and 7*b*. Outer gusset 128 may have a radius of curvature $R_{128a}$ at first tip 128*a* and/or a radius of curvature $R_{128b}$ at second tip 128*b*. In some embodiments, radii of curvature $R_{127a}$ and/or $R_{127b}$ of inner gussets 127 may be greater than radii of curvature $R_{128a}$ and/or $R_{128b}$ of outer gussets 128. As discussed above, a smaller radius of curvature at either tip of outer gusset 128 may enhance structural rigidity and a larger radius of curvature at either tip of inner gusset 127 may facilitate part removal following thermoforming or molding.

It is understood that cup 5 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that cup 5 or any component thereof may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of cup 5.

It is further understood that any of a variety of processes or combination thereof may be used to form cup 5, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, cup 5 and/or any component thereof may be formed substantially of thermoformed polypropylene. Various materials and/or processes may be used to form cup 5 and/or any component thereof as will be understood by one of ordinary skill in the art. In some embodiments, cup 5 may be substantially a one-piece design and/or substantially formed as an integral or unitary structure.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A beverage brewing cup, comprising:

a side wall and a floor at least partially defining a product storage region;

the floor having a center area, an inner gusset area, a puncture area, and an outer gusset area;

the center area disposed axially above the puncture area, the inner gusset area extending between and interconnecting the center area and the puncture area;

the side wall disposed axially above the puncture area and the outer gusset area, the outer gusset area extending between and interconnecting the puncture area and the side wall;

the inner gusset area including a plurality of inner gussets;

the outer gusset area including a plurality of triangular outer gussets;

the puncture area in the floor disposed between and interconnecting the inner gusset area and the outer gusset area; and wherein the outer gusset area has a top edge coupled to a lower edge of the side wall, a bottom edge coupled to an outer edge of the puncture area, a plurality of outer gusset first tips, and a plurality of outer gusset second tips, wherein the outer gusset first tips and outer gusset second tips are arranged in an alternating circumferential pattern, wherein the outer gusset second tips are disposed radially outwardly of the outer gusset first tips, and wherein each outer gusset first tip has a first vertex each with a same shape among the plurality of outer gusset first tips and each outer gusset second tip has a second vertex each with a same shape among the plurality of outer gusset second tips;

wherein each outer gusset first tip of the plurality of outer gusset first tips and each outer gusset second tip of the plurality of outer gusset second tips is disposed: (i) entirely below the lower edge of the side wall and (ii) above the bottom edge of the outer gusset area and the outer edge of the puncture area; and wherein the floor is formed of a thermoformable material.

2. The beverage brewing cup of claim 1, wherein the puncture area is thinner than the center area.

3. The beverage brewing cup of claim 2, wherein the puncture area has a thickness in the range of about 0.007" to about 0.016".

4. The beverage brewing cup of claim 2, wherein the center area has a thickness in the range of about 0.015" to about 0.030".

5. The beverage brewing cup of claim 2, wherein the center area has a thickness in the range of about 0.015" to about 0.022".

6. The beverage brewing cup of claim 1, wherein the inner gusset area has a plurality of inner gusset first tips.

7. The beverage brewing cup of claim 6, wherein the outer gusset first tips have a radius of curvature that is less than a radius of curvature of the inner gusset first tips.

8. The beverage brewing cup of claim 7, wherein the outer gussets have rounded outer gusset first tips and wherein the inner gussets have a rounded shape with more pronounced rounded inner gusset first tips than the outer gusset first tips.

9. The beverage brewing cup of claim 1, wherein the outer gusset first tips are disposed lower than the outer gusset second tips when the floor is lower than the side wall.

10. The beverage brewing cup of claim 8, wherein the inner gussets have inner gusset second tips, and wherein the outer gusset first tips have a radius of curvature that is less than a radius of curvature of the inner gusset second tips.

11. The beverage brewing cup of claim 10, wherein the inner gusset first tips and inner gusset second tips are arranged in an alternating circumferential pattern, and wherein the inner gusset second tips are disposed radially inwardly of the inner gusset first tips.

12. The beverage brewing cup of claim 11, wherein the inner gusset first tips are disposed lower than the inner gusset second tips when the floor is lower than the side wall.

13. A beverage brewing cup, comprising:

a side wall and a floor at least partially defining a product storage region;

a brim disposed axially opposite the floor, the brim surrounding an opening into the product storage region;

the floor having a center area, an inner gusset area, a puncture area, and an outer gusset area;

the center area disposed axially above the puncture area and the inner gusset area extending between and interconnecting the center area and the puncture area;

the side wall disposed axially above the puncture area and the outer gusset area, the outer gusset area extending between and interconnecting the puncture area and the side wall;

the puncture area in the floor disposed between and interconnecting the inner gusset area and the outer gusset area;

the puncture area having a thickness that is less than a thickness of the center area;

wherein the inner gusset area has a plurality of inner gussets and a plurality of inner gusset first tips;

wherein the outer gusset area has a plurality of outer gussets and a plurality of outer gusset first tips; and wherein the outer gusset first tips have a radius of curvature that is less than a radius of curvature of the inner gusset first tips;

wherein the floor is formed of a thermoformable material, wherein the puncture area includes an inner edge connected to the inner gusset area and an outer edge connected to the outer gusset area, and wherein the side wall includes a lower edge coupled to an upper edge of the outer gusset area, wherein the lower edge is entirely above the outer gusset area, and wherein the outer edge of the puncture area is entirely below the outer gusset area and the inner gusset area.

14. The beverage brewing cup of claim 13, wherein the outer gussets have a triangular shape with rounded tips and wherein each inner gusset first tip of the inner gusset first tips has a rounded shape with more pronounced rounded tips than the outer gusset tips.

15. The beverage brewing cup of claim 13, wherein the inner gussets have inner gusset second tips, and wherein the outer gusset first tips have a radius of curvature that is less than a radius of curvature of the inner gusset second tips.

16. The beverage brewing cup of claim 15, wherein the inner gusset first tips and inner gusset second tips are arranged in an alternating circumferential pattern, and wherein the inner gusset second tips are disposed radially inwardly of the inner gusset first tips.

17. A beverage brewing cup, comprising:

a side wall and a floor at least partially defining a product storage region;

the floor having a center area, an inner gusset area, a puncture area, and an outer gusset area;

the center area disposed axially above the puncture area and the inner gusset area extending between and interconnecting the center area and the puncture area;

the side wall disposed entirely axially above the puncture area and the outer gusset area, the outer gusset area extending between and interconnecting the puncture area and the side wall;

the inner gusset area including a plurality of inner gussets;

the outer gusset area including a plurality of outer gussets;

the puncture area in the floor disposed between and interconnecting the inner gusset area and the outer gusset area;

wherein the inner gusset area has a plurality of inner gussets that includes a plurality of inner gusset first tips and the outer gusset area has a plurality of outer gussets including a plurality of outer gusset first tips;

wherein the outer gusset first tips have a radius of curvature that is less than a radius of curvature of the inner gusset first tips; and wherein the outer gussets have a triangular shape with rounded first tips and wherein each inner gusset first tip of the plurality of inner gusset first tips has a rounded shape with more pronounced rounded tips than the outer gusset first tips;

wherein the floor is formed of a thermoformable material, and wherein the plurality of inner gussets have an inner gusset height and the plurality of outer gussets have an outer gusset height, and wherein the outer gusset height is greater than the inner gusset height such that the sidewall is entirely above the outer gusset area and the inner gusset area.

18. The beverage brewing cup of claim 17, wherein the floor further comprises an outer edge interposed between the puncture area and the outer gusset area, wherein the outer edge is stepped downwardly relative to the puncture area, and wherein the outer gusset area is disposed entirely below the side wall.

19. The beverage brewing cup of claim 17, wherein the plurality of inner gussets have a plurality of inner front edges extending downwardly at a first angle $\alpha$ relative to the center area and the plurality of outer gussets have a plurality of outer front edges extending downwardly at a second angle $\beta$ relative to the center area, wherein first angle $\alpha$ is greater than second angle $\beta$.

* * * * *